US008118456B2

(12) United States Patent
Reed et al.

(10) Patent No.: US 8,118,456 B2
(45) Date of Patent: Feb. 21, 2012

(54) LOW-PROFILE PATHWAY ILLUMINATION SYSTEM

(75) Inventors: William G. Reed, Seattle, WA (US); John O. Renn, Lake Forest Park, WA (US)

(73) Assignee: Express Imaging Systems, LLC, Seattle, WA (US)

( * ) Notice: Subject to any disclaimer, the term of this patent is extended or adjusted under 35 U.S.C. 154(b) by 302 days.

(21) Appl. No.: 12/437,472

(22) Filed: May 7, 2009

(65) Prior Publication Data

US 2009/0278474 A1 Nov. 12, 2009

Related U.S. Application Data

(60) Provisional application No. 61/051,619, filed on May 8, 2008.

(51) Int. Cl.
*F21V 3/00* (2006.01)

(52) U.S. Cl. ..... 362/311.02; 362/382; 362/457; 362/200; 362/249.01; 362/249.02

(58) Field of Classification Search ..... 362/311.02, 362/431, 382, 457, 200, 249.01, 249.02
See application file for complete search history.

(56) References Cited

U.S. PATENT DOCUMENTS

| | | | | |
|---|---|---|---|---|
| 4,153,927 | A * | 5/1979 | Owens | 362/99 |
| 5,086,379 | A * | 2/1992 | Denison et al. | 362/145 |
| 5,160,202 | A | 11/1992 | Légaré | 362/153.1 |
| 5,230,556 | A * | 7/1993 | Canty et al. | 362/562 |
| 5,343,121 | A | 8/1994 | Terman et al. | 315/158 |
| 5,349,505 | A * | 9/1994 | Poppenheimer | 362/101 |
| 5,589,741 | A | 12/1996 | Terman et al. | 315/360 |
| 6,111,739 | A | 8/2000 | Wu et al. | |
| 6,612,720 | B1 * | 9/2003 | Beadle | 362/287 |
| 7,122,976 | B1 | 10/2006 | Null et al. | 315/362 |

(Continued)

FOREIGN PATENT DOCUMENTS

DE 4001980 8/1990

(Continued)

OTHER PUBLICATIONS

Reed et al., "Apparatus, Method to Change Light Source Color Temperature with Reduced Optical Filtering Losses," U.S. Appl. No. 61/295,519, filed Jan. 15, 2010, 35 pages.

(Continued)

*Primary Examiner* — Evan Dzierzynski
(74) *Attorney, Agent, or Firm* — Seed IP Law Group PLLC

(57) ABSTRACT

A luminaire to illuminate surfaces comprises a housing, a mounting fixture and a light source. The housing includes a base having a bottom surface positionable on a surface to be illuminated, an interior, and at least one window providing access between the interior and an exterior of the housing. The mounting fixture extends at least approximately perpendicularly downward with respect to the bottom surface of the base to secure the housing into a peripheral portion of the surface to be illuminated. The light source has a principal axis of emission that is directed outwardly through the window of the housing at a downwardly oriented angle with respect to the bottom surface of the base such that, when in use with the luminaire mounted to the surface to be illuminated, the principal axis of emission of the light source is directed at a portion of the surface to be illuminated.

18 Claims, 6 Drawing Sheets

U.S. PATENT DOCUMENTS

| | | | | |
|---|---|---|---|---|
| 7,239,087 | B2 | 7/2007 | Ball | 315/128 |
| 7,317,403 | B2 | 1/2008 | Grootes et al. | 340/815.45 |
| 7,339,323 | B2 | 3/2008 | Bucur | 315/128 |
| 7,339,471 | B1 | 3/2008 | Chan et al. | 340/541 |
| 2004/0095772 | A1 | 5/2004 | Hoover et al. | 362/363 |
| 2004/0105264 | A1 | 6/2004 | Spero | |
| 2004/0120148 | A1 | 6/2004 | Morris | |
| 2004/0201992 | A1* | 10/2004 | Dalton et al. | 362/276 |
| 2005/0099802 | A1* | 5/2005 | Lai | 362/153 |
| 2005/0135101 | A1 | 6/2005 | Richmond | 362/276 |
| 2005/0174780 | A1 | 8/2005 | Park | |
| 2005/0243022 | A1 | 11/2005 | Negru | 345/46 |
| 2005/0254013 | A1 | 11/2005 | Engle et al. | |
| 2006/0001384 | A1 | 1/2006 | Tain et al. | |
| 2006/0014118 | A1 | 1/2006 | Utama | 433/31 |
| 2006/0034075 | A1* | 2/2006 | Alessio | 362/202 |
| 2006/0158130 | A1 | 7/2006 | Furukawa | 315/200 R |
| 2006/0202914 | A1 | 9/2006 | Ashdown | |
| 2006/0262544 | A1* | 11/2006 | Piepgras et al. | 362/373 |
| 2006/0277823 | A1 | 12/2006 | Barnett et al. | 47/33 |
| 2007/0096118 | A1 | 5/2007 | Mahalingam et al. | |
| 2007/0102033 | A1 | 5/2007 | Petrocy | |
| 2007/0159819 | A1* | 7/2007 | Bayat et al. | 362/236 |
| 2007/0247853 | A1 | 10/2007 | Dorogi | 362/294 |
| 2007/0279921 | A1 | 12/2007 | Alexander et al. | 362/368 |
| 2008/0130304 | A1* | 6/2008 | Rash et al. | 362/477 |
| 2008/0266839 | A1* | 10/2008 | Claypool et al. | 362/106 |
| 2008/0271065 | A1 | 10/2008 | Buonasera et al. | 725/10 |
| 2008/0291661 | A1* | 11/2008 | Martin | 362/101 |
| 2010/0060130 | A1 | 3/2010 | Li | 313/46 |
| 2010/0090577 | A1 | 4/2010 | Reed et al. | 313/46 |
| 2010/0123403 | A1 | 5/2010 | Reed | 315/193 |
| 2010/0277082 | A1 | 11/2010 | Reed et al. | 315/159 |
| 2010/0295454 | A1 | 11/2010 | Reed | 315/152 |
| 2010/0295455 | A1 | 11/2010 | Reed | 315/152 |
| 2010/0295946 | A1 | 11/2010 | Reed et al. | 348/164 |

FOREIGN PATENT DOCUMENTS

| | | |
|---|---|---|
| EP | 1 734 795 | 12/2006 |
| FR | 2883306 | 9/2006 |
| JP | 2001-333420 | 11/2001 |
| JP | 2004/349065 | 12/2004 |
| JP | 2006/244711 | 9/2006 |
| WO | 02/076068 | 9/2002 |
| WO | 03/056882 | 7/2003 |
| WO | 2006/057866 | 6/2006 |
| WO | 2007/036873 | 4/2007 |
| WO | 2008/030450 | 3/2008 |
| WO | 2009/040703 A2 | 4/2009 |

OTHER PUBLICATIONS

Reed, "Apparatus and Method of Energy Efficient Illumination," U.S. Appl. No. 61/333,983, filed May 12, 2010, 57 pages.

Reed, "Apparatus and Method of Energy Efficient Illumination," U.S. Appl. No. 61/346,263, filed May 19, 2010, 67 pages.

Renn et al., "Solid State Lighting Device and Method Employing Heat Exchanger Thermally Coupled Circuit Board," U.S. Appl. No. 61/357,421, filed Jun. 22, 2010, 49 pages.

International Search Report, mailed Jul. 9, 2009 for PCT/US2009/043171, 3 pages.

Written Opinion, mailed Jul. 9, 2009 for PCT/US2009/043171, 8 pages.

International Search Report, mailed Jun. 21, 2010 for PCT/US2009/064625, 3 pages.

Written Opinion, mailed Jun. 21, 2010 for PCT/US2009/064625, 5 pages.

International Search Report, mailed Dec. 13, 2010 for PCT/US2010/035649, 3 pages.

Written Opinion, mailed Dec. 13, 2010 for PCT/US2010/035649, 4 pages.

U.S. Appl. No. 12/437,467, filed May 7, 2009, Reed et al.

U.S. Appl. No. 12/540,250, filed Aug. 12, 2009, Reed et al.

U.S. Appl. No. 61/051,619, filed May 8, 2008, Reed et al.

U.S. Appl. No. 61/052,924, filed May 13, 2008, Reed et al.

U.S. Appl. No. 61/088,651, filed Aug. 13, 2008, Reed et al.

U.S. Appl. No. 61/155,438, filed Nov. 17, 2008, Reed.

U.S. Appl. No. 61/154,619, filed Feb. 23, 2009, Reed.

U.S. Appl. No. 61/174,913, filed May 1, 2009, Reed et al.

U.S. Appl. No. 61/180,017, filed May 20, 2009, Reed et al

U.S. Appl. No. 61/229,435, filed Jul. 29, 2009, Reed et al.

* cited by examiner

LOW-PROFILE PATHWAY ILLUMINATION SYSTEM

CROSS-REFERENCE TO RELATED APPLICATION

This application claims the benefit under 35 U.S.C. §119 (e) of U.S. Provisional Patent Application Ser. No. 61/051,619, filed May 8, 2008, entitled "Low-Profile Pathway Illumination System", which is incorporated herein by reference in its entirety.

BACKGROUND

1. Technical Field

This disclosure generally relates to an illumination system and more particularly to a low-profile pathway illumination system.

2. Description of the Related Art

Pathway lighting is important for safety and security reasons and, in some cases, for aesthetic reasons as well. In general, existing pathway lights can be grouped into three main classes: bollards and overhead lighting systems that are installed on poles or walls, lighting systems mounted close to the ground, and "paver lights" installed in a pathway surface. Further, pathway lights can be divided into low voltage and mains voltage lighting systems.

Overhead and bollard lighting systems are typically robust and permanent, but tend to have relatively high costs of installation and maintenance. These lighting systems are typically powered by the mains voltage and typically require expensive waterproof conduits, concrete support bases and careful planning to install. Professional contractors are usually required to install these lighting systems. Besides, the electronic controls, sensors and timers required for their operation are expensive and must be installed by licensed electricians. Overhead and bollard lighting systems also tend to detract from the aesthetics of the architecture, landscaping and natural features where they are sited. In some cases, both the luminaires and the light they emit block the view of the carefully designed environment that they are lighting, and greatly detract from the visual enjoyment of the site.

There are also lighting systems that are mounted close to the ground or pathway that they illuminate. These near-ground lighting systems, however, may be less robust as they tend to suffer from the small size of their mountings. In addition, a greater quantity of these small lights is typically required to properly illuminate a pathway relative to, for example, bollards or overhead lighting. Maintenance costs associated with these small, near-ground lighting systems can be high because of the large number of lamps that eventually need replacement, physical damage to the more delicate luminaires, and the close proximity of the luminaires to lawn maintenance equipment and pathway traffic. While aesthetically more pleasing than overhead lights or bollards, these near-ground lighting systems also detract from a well-designed space, cluttering the pathway with fragile-looking luminaires.

Paver lights, lights that are installed in the pathway surface, typically provide little or no illumination of the pathway surface and are used primarily for the purpose of delimiting the pathway. These lights tend to be difficult to install and maintain because they are designed to be embedded in the pathway surface material. Installation is especially difficult and expensive if paver lights are to be installed into existing concrete sidewalks. Additionally, power wires must be run under the pathway, further making them difficult and expensive to install and maintain. Moreover, because typical paver lights emit almost all of their light upwards into the sky, they do not always illuminate potentially dangerous objects left on the pathway or other hazards on the pathway. Worse yet, paver lights may obscure the presence of potential hazards by shining upwards into a pedestrian's eyes.

An important concern with pathway lighting is the grounds maintenance costs associated with mowing and weed-removal activities around each luminaire. In the case of overhead or bollard lights, a very real danger exists of collision from riding lawn mowers, maintenance trucks and carts, or from individuals engaged in sports or other activities. Near-ground pathway lights are very costly to mow or weed around, and may easily be damaged in the process. They also present a hazard to pedestrians who may trip over or onto the relatively short luminaires.

There is, therefore, a need for a lighting system that is relatively easier and less costly to install and replace compared to the existing pathway lighting systems, and has a low profile to minimize danger from collision and tripping as well as detraction with the aesthetics of the site.

BRIEF SUMMARY

A luminaire to illuminate surfaces may be summarized as including a housing including a base having a bottom surface that is positionable on a surface to be illuminated, the housing including an interior and at least one window providing access between the interior of the housing and an exterior of the housing; a mounting fixture extending at least approximately perpendicularly downward with respect to the bottom surface of the base to secure the housing to a peripheral portion of the surface to be illuminated; and a light source received in the interior of the housing, the light source having a principal axis of emission that is directed outwardly through the window of the housing at a downwardly oriented angle with respect to the bottom surface of the base such that, when in use with the luminaire mounted to the surface to be illuminated, the principal axis of emission of the light source is directed at a portion of the surface to be illuminated.

The mounting fixture may include at least one mounting hole sized to receive a portion of a respective fastener. The base and the mounting fixture may each be separate unitary parts that are physically coupled together. The light source may include at least one light emitting device. The light source may include at least one solid-state light emitting device. The light source may include at least one light-emitting diode. The luminaire may further include a controller coupled to regulate power to the light source. The controller may be configured to regulate power at a voltage level within a threshold from a voltage level of a power source to permit full light emission by the light source. The controller may be configured to regulate power to the light source to adjust an intensity of the light emitted by the light source according to a voltage of power from a power source. The luminaire may further include a controller housing physically coupled to the mounting fixture, the controller housing having an interior in which the controller is received, wherein the housing, the mounting fixture and the controller housing each includes at least one respective passage to provide communication between the controller in the interior of the controller housing and the light source in the interior of the housing. The window may include a substantially transparent member positioned in an opening of the housing to environmentally isolate the interior of the housing from the exterior thereof. The substantially transparent member may be a toughened glass made of one of Chrysterna and Pyrex. The substantially transparent member may be coated with one of artificial diamond-like deposition and sapphire. The window may have a shape that forms the light emitted by the light source into a light beam when exiting the housing, the light beam having a vertical angle of +/−10 degrees relative to a horizontal plane parallel to the surface to be illuminated and a horizontal angle of at least +/−70 degrees along the horizontal plane. The housing may have a height of less than 0.75 inch measured from the surface when positioned on the surface to be illuminated. The interior of the housing may be environmentally sealed from the exterior thereof. A top portion of the interior of the housing, at least partially between the light source and the window, may have high reflectance, and wherein a bottom portion of the interior of the housing, at least partially between the light source and the window, may have low reflectance.

A pathway light may be summarized as including a solid-state device configured to emit light when powered; a control circuit coupled to the solid-state device and a power input, the control circuit configured to receive power from the power input and provide regulated power to the solid-state device; and a housing for enclosing the solid-state device and the control circuit, the housing constructed to withstand contact by moving equipment and function as a heat sink for the solid-state device and the control circuit, the housing having an opening shaped and angled to project light emitted by the solid-state device onto and across a surface to be illuminated when the pathway light is placed on the surface in a position for operation.

The solid-state device may include at least one light-emitting diode. The housing may have a height of less than 0.75 inch measured from the surface when placed on the surface in the position for operation. The control circuit may include a low dropout voltage regulator configured to adjust an intensity of the light emitted by the solid-state device according to a voltage level of the power from the power input. The housing may be at least partially placed on the surface when the pathway light is in operation, and wherein the housing may have a maximum height of less than 0.75 inch measured from the surface when the housing is placed on the surface. The housing may further have an extension that extends from the housing in a direction such that when the pathway light is in the position for operation with the extension inserted into a discontinuity in the surface or into a gap between the surface and an adjacent surface the light from the solid-state device is projected onto and across the surface through the opening of the housing. The pathway light may further include a hardened glass that is substantially transparent and placed in the opening of the housing to protect the solid-state device from moisture and physical damage, and wherein the hardened glass is coated with one of artificial diamond-like deposition and sapphire for extended life. The opening of the housing may form the light emitted by the solid-state device into a light beam having a vertical angle of +/−10 degrees relative to a horizontal plane parallel to the surface to be illuminated and a horizontal angle of at least +/−70 degrees along the horizontal plane.

Figure 1A:
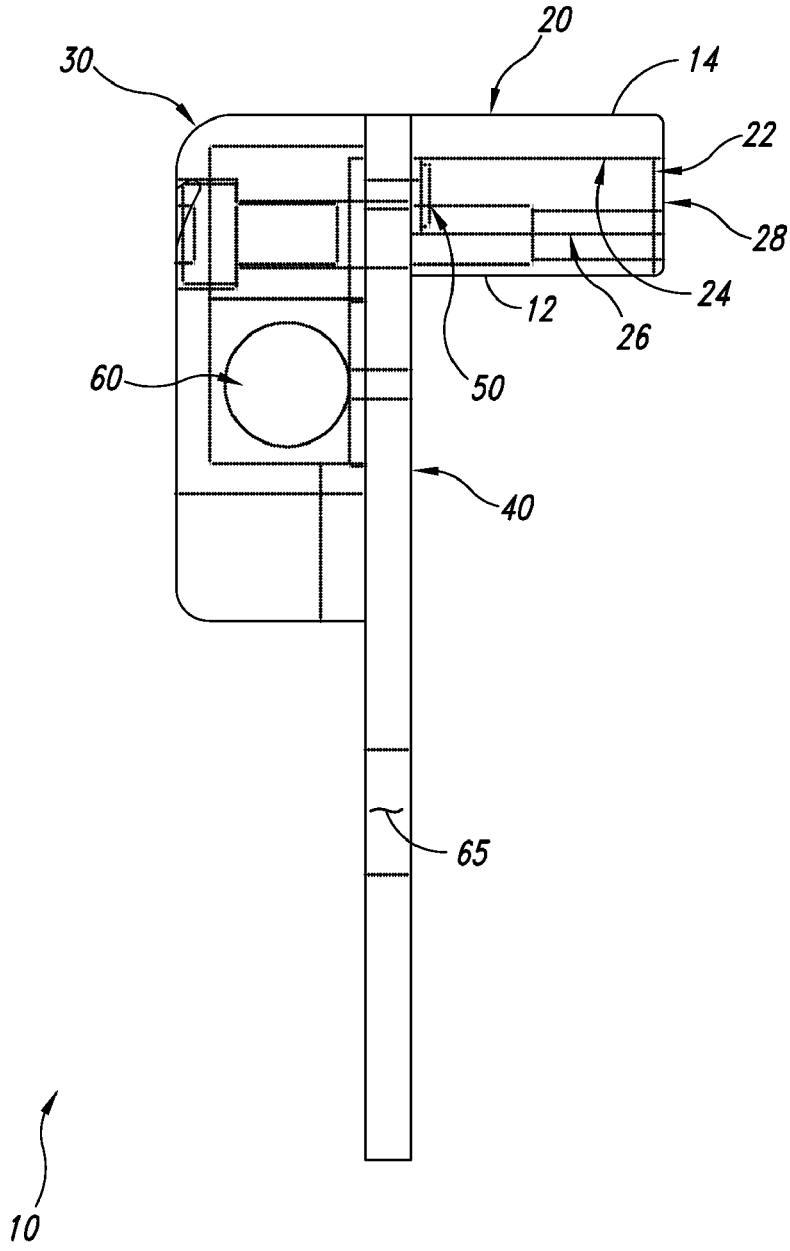
FIG. 1A is a front elevational view of a pathway light according to one non-limiting illustrated embodiment.

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with lighting fixtures, power generation and/or power systems for lighting have not been shown or described in detail to avoid unnecessarily obscuring descriptions of the embodiments.

Unless the context requires otherwise, throughout the specification and claims which follow, the word "comprise" and variations thereof, such as "comprises" and "comprising," are to be construed in an open, inclusive sense that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings and Abstract of the Disclosure provided herein are for convenience only and do not interpret the scope or meaning of the embodiments.

FIG. 1A shows a luminaire in the form of a pathway light 10 according to one non-limiting illustrated embodiment. The pathway light 10 comprises a light source housing 20 and a controller housing 30 for enclosing the electrical components of the pathway light 10. As shown in FIG. 1A, a light source, which may be a solid-state device such as a light-emitting diode (LED) device 50, is housed in the light source housing 20 while electronics that control the light source, such as controller 60, is housed in the controller housing 30. Alternatively, the pathway light 10 may have a single, unitary housing (not shown) in which both the light source and electronics are contained. Unless otherwise specified, in the following description the word "housing" refers to the light source housing 20 and the controller housing 30 in embodiments similar to that shown in FIG. 1A, and refers to the single housing that contains both the light source and the electronics that control the light source in other embodiments.

In one embodiment, the light source may comprise the LED device 50, which may include one or more LEDs, such as an array of LEDs. In an alternative embodiment, the light source may be another type of solid-state lighting, such as one or more organic light-emitting diodes or polymer light-emitting diodes. The quantity and color of LEDs in the LED device 50 depend on the intensity and color of light desired. In one embodiment, the LED device 50 comprises a number of LEDs combined together to form a long and narrow light emitter to produce white light with intensity strong enough to illuminate at least a portion of a pathway proximate to where the pathway light 10 is installed.

Figure 1B:
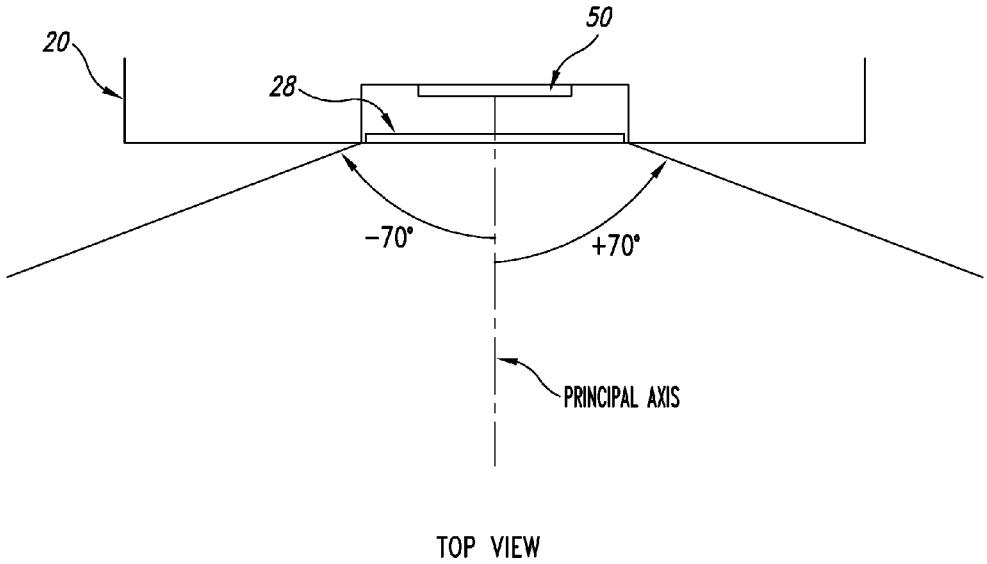
FIG. 1B is top plan view of a pathway light of FIG. 1A.

The housing has an opening, e.g., a window 28, through which light emitted by the LED device 50 can exit the housing. A substantially transparent member 22 is fitted in the window 28 of the housing to protect the LED device 50 from moisture and physical damage (e.g., due to weed removal string trimmers, rocks, sand). The window 28 is shaped and angled so that the resultant light beam projected from the pathway light 10 through the window 28 has a desired shape and is projected at a desired angle. In one embodiment, the light beam is very narrow in a vertical axis with respect to the plane of the pathway to be illuminated and very broad in a horizontal axis parallel with the plane of the pathway, and the light beam is oriented at an angle such that the light beam is projected onto and across the pathway. In this way, the pathway is well illuminated over a wide area in front of the pathway light 10. In an embodiment, when mounted to a pathway, the bottom surface of the housing of the pathway light 10 is approximately parallel with the top surface of the pathway to be illuminated. In one embodiment, as shown in FIG. 1B, the light source has a principal axis of emission that is directed outwardly through the window 28 at a downwardly oriented angle with respect to the bottom surface of the housing such that the principal axis of emission of the light source is directed at a portion of the surface to be illuminated. In one embodiment, the light beam exits the housing at a vertical angle of +/−10 degrees in the vertical axis, and an angle of +/−70 degrees in the horizontal axis.

An interior channel exists in the housing between the window 28 and the light source. In one embodiment, the interior channel has a narrow shape that confines the light output to a wide aspect-ratio beam. In one embodiment, the bottom portion of the interior channel is coated or covered with a low-reflectance material (e.g., flat black anodizing, or light absorber 26) to reduce upward glare, and the top portion of the interior channel is coated or covered with a high-reflectance material (e.g., aluminum mirror 24) to help increase the light projected through the substantially transparent member 22. The substantially transparent member 22 permits high transmission of light out of the pathway light 10 but prevents water or other foreign matter from entering the housing. In one embodiment, the substantially transparent member 22 is hardened or toughened glass, which may be coated with an abrasion resistant coating. In one embodiment, toughened glass such as Chrysterna or Pyrex may be used for the substantially transparent member 22, and coatings of artificial diamond-like deposition or sapphire may be applied to extend the useful life of the substantially transparent member 22.

Figure 1C:
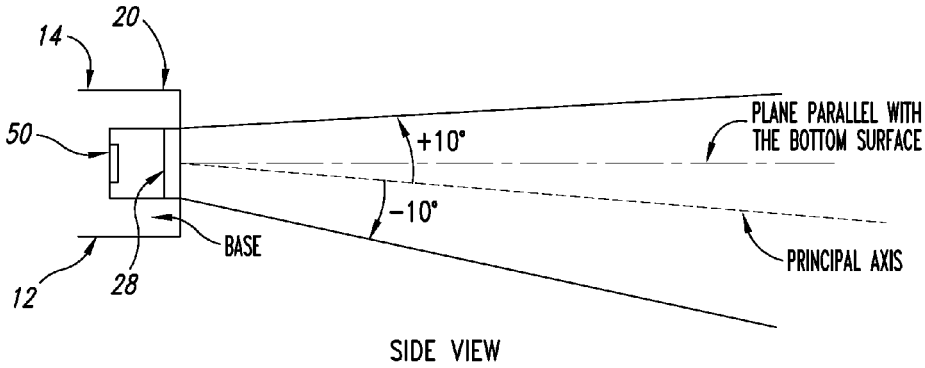
FIG. 1C is a side elevational view of the pathway light of FIG. 1A.
Figure 2:
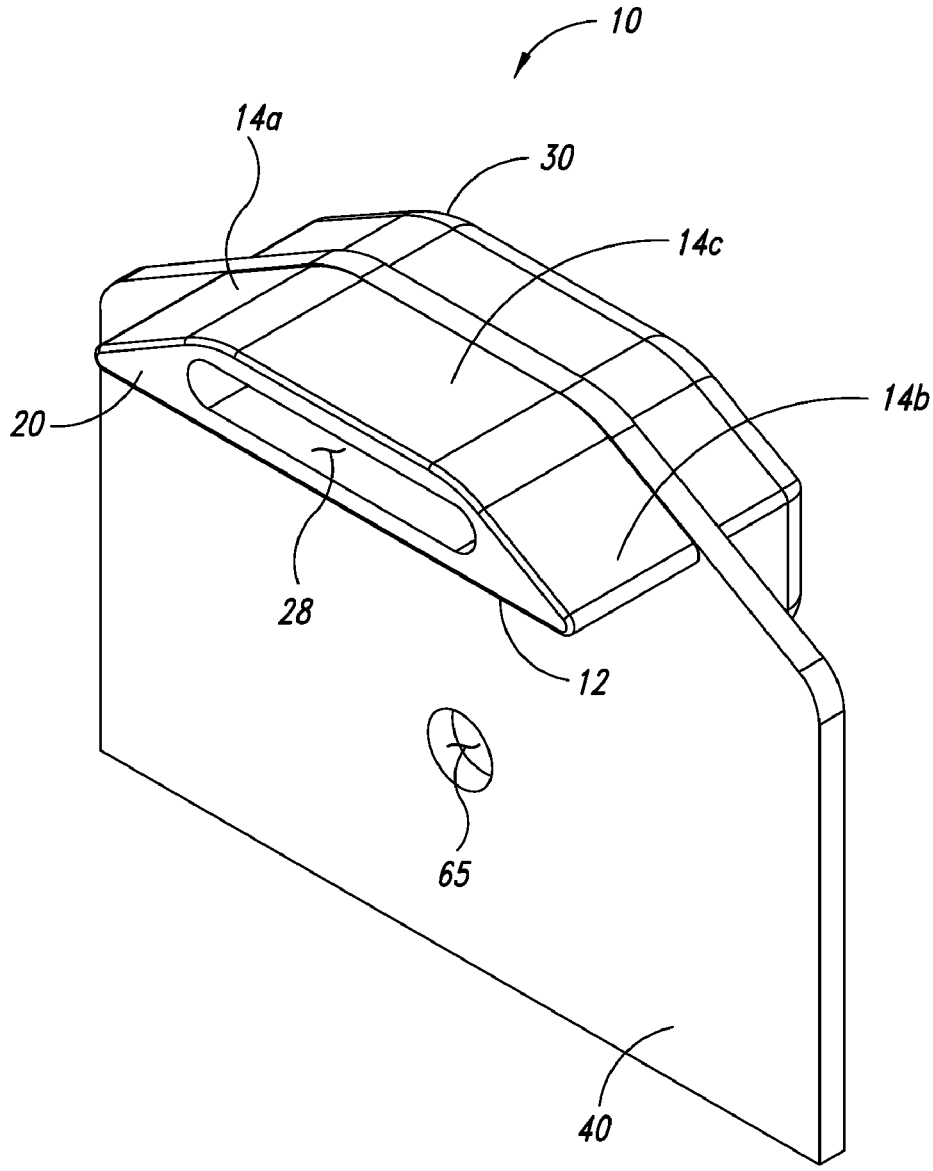
FIG. 2 is an isometric view of the pathway light of FIG. 1A.

The housing of pathway light 10 is preferably watertight to eliminate damage from or entry of moisture due to lawn watering, rain, pressure washing, etc. The housing is preferably constructed to be very rugged and can withstand direct contact or impact by moving equipment. For example, the housing should be very rugged to allow the wheels of lawnmowers, trucks and carts to drive over the pathway light 10 without causing damage to the pathway light 10 or the vehicle's tires. The outer contour of the housing is shaped in a way to eliminate sharp edges or corners to minimize the chance of tripping a pedestrian or catching a moving object. As best illustrated in FIGS. 1C and 2, a portion of the housing of the pathway light 10 includes a bottom surface 12 and a top surface 14 having a pair of portions 14*a*, 14*b* that slope toward the bottom surface 12 from an intermediate portion 14*c*. The material which the housing is made of is preferably chosen so that not only the housing is rugged but may additionally function as a heat sink to allow the heat generated by the light source (e.g., the LED device 50) and electronics (e.g., the controller 60) to be transferred to the ambient environment by conduction, convection and radiation via the housing. For example, aluminum or another metal or alloy may be employed. Additionally, the pathway light 10 is sealed using silicone, epoxy or other sealing material.

The pathway light 10 further comprises a mounting fixture 40 (e.g., bracket or plate) for mounting the pathway light 10. The mounting fixture 40 may be a unitary part of the housing or a separate part assembled together with the housing. In one embodiment, the mounting fixture 40 may be a mounting plate that extends vertically downward from the housing. Alternatively, the mounting fixture 40 may be in another shape and/or extend from the housing in another direction, such as in a horizontal direction. The light source, such as the LED device 50, may be mounted to the mounting fixture 40. The mounting fixture 40, together with the housing, may serve as a heat sink for both the light source and the electronics.

Various methods may be used to affix the pathway light 10 to the pathway, sidewalk or whatever surface the luminaire is used to illuminate. In one embodiment, with the mounting fixture 40 being a mounting plate, the pathway light 10 can be relatively easily mounted by inserting the mounting fixture 40 into a discontinuity in the pathway surface, such as a slot or a crevice, or into a gap between an edge of the pathway and an edge of an adjacent surface, such as lawn, gravel ground, dirt ground, pavement, etc. In another embodiment, the pathway light 10 may be affixed by using a bolt through the mounting fixture 40 that is shaped like a plate with a hole 65 (FIG. 2) in it. In an alternative embodiment, adhesive material for bonding may be used. A high-quality polyurethane concrete adhesive is a preferred adhesive material when the pathway light 10 is to be affixed to concrete. In yet another embodiment, a combination of a bolt and adhesive material may be used. In any event, because the pathway light 10 is affixed to the pathway via the mounting fixture 40, no poured concrete base is needed as with bollards or overhead lights, and, rather, mounting fixture 40 allows the pathway light 10 to be relatively easily installed and removed.

When installed at the level of the pathway or sidewalk, the pathway light 10 has a very low profile in that the top of the housing has a height of less than a particular dimension such that the low profile enables lawn mowers, trucks and carts to pass directly over the pathway light 10. In one embodiment, the height of the housing is less than 0.75 inch to reduce the possibility of pedestrians tripping on the housing. In some states in the United States, the height of 0.75 inch is considered the maximum acceptable safe height for protuberances on walkways.

By installing the pathway light 10 at the level of the surface to be illuminated, the aforementioned problems with overhead and near-ground pathway lights are reduced or eliminated. Because of the low profile of the pathway light 10, pedestrians, law mowers, trucks and carts can pass directly over the luminaire, and the danger of collision or tripping is substantially reduced. The costs associated with installation and maintenance are lower, compared to the costs for installing and maintaining bollards, overhead lighting or near-ground lighting, as pathway light 10 can be relatively easily installed and removed. Further, by projecting light directly onto and across the pathway or sidewalk, the pathway light 10 has much less impact on the aesthetic perception of the environment and is "dark sky" friendly due to its illumination being confined substantially to the pathway surface. The use of a solid-state device for illumination reduces energy consumption versus incandescent or other traditional light sources by as much as 80%.

FIG. 2 is an isometric view of the pathway light 10 according to a non-limiting illustrated embodiment. As shown, the mounting fixture 40 is a mounting plate with a hole 65 in it for mounting with a bolt. The housing has a long and very narrow window 28 that allows a light beam long in the horizontal axis and very narrow in the vertical axis to be projected onto and across a surface when the pathway light 10 is installed at an edge of the surface.

Figure 3A:
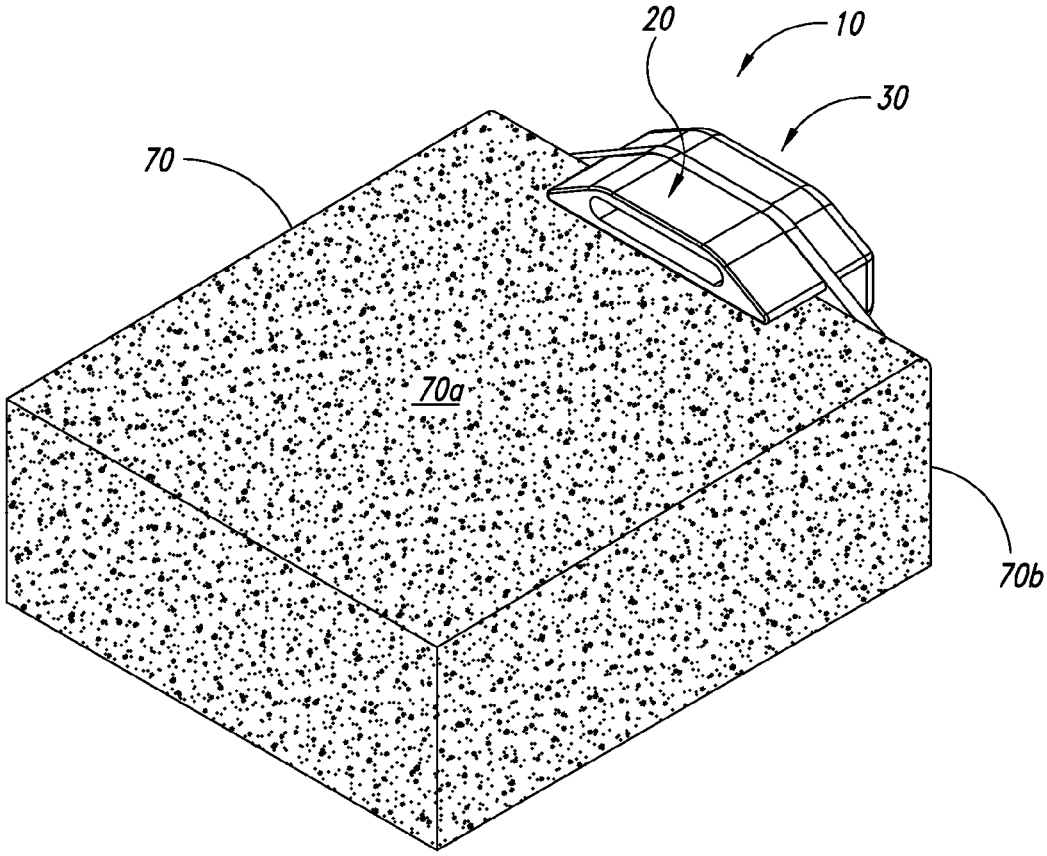
FIGS. 3A-3B are each a diagram illustrating a pathway light in use according to one non-limiting illustrated embodiment.

FIG. 3A shows the pathway light 10 installed on a concrete sidewalk 70. When the pathway light 10 is installed at the level of the sidewalk 70, the light source housing 20 may be placed directly on the top surface 70*a* of the sidewalk 70. As can be seen, the low profile of the pathway light 10 results in minimal protuberance of the housing above the top surface 70*a* of the sidewalk 70.

Figure 3B:
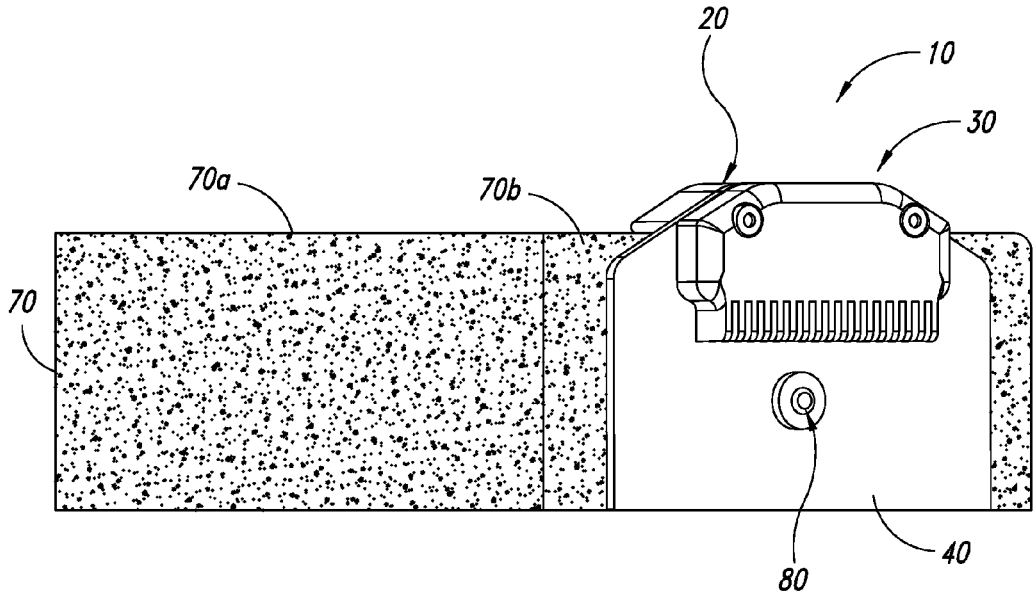

FIG. 3B shows the pathway light 10 installed on the concrete sidewalk 70 looking from a different angle. A bolt 80, as shown, may be used to affix the pathway light 10 to a vertical surface or peripheral edge 70*b* of the sidewalk 70. The bolt 80 may be pre-cast into the concrete or directly driven into the concrete. Alternatively, a plastic or metal anchor may be installed in the concrete to accept the bolt 80. Similar installation methods may be used for installation onto wood, metal or bituminous pathways.

Figure 4:
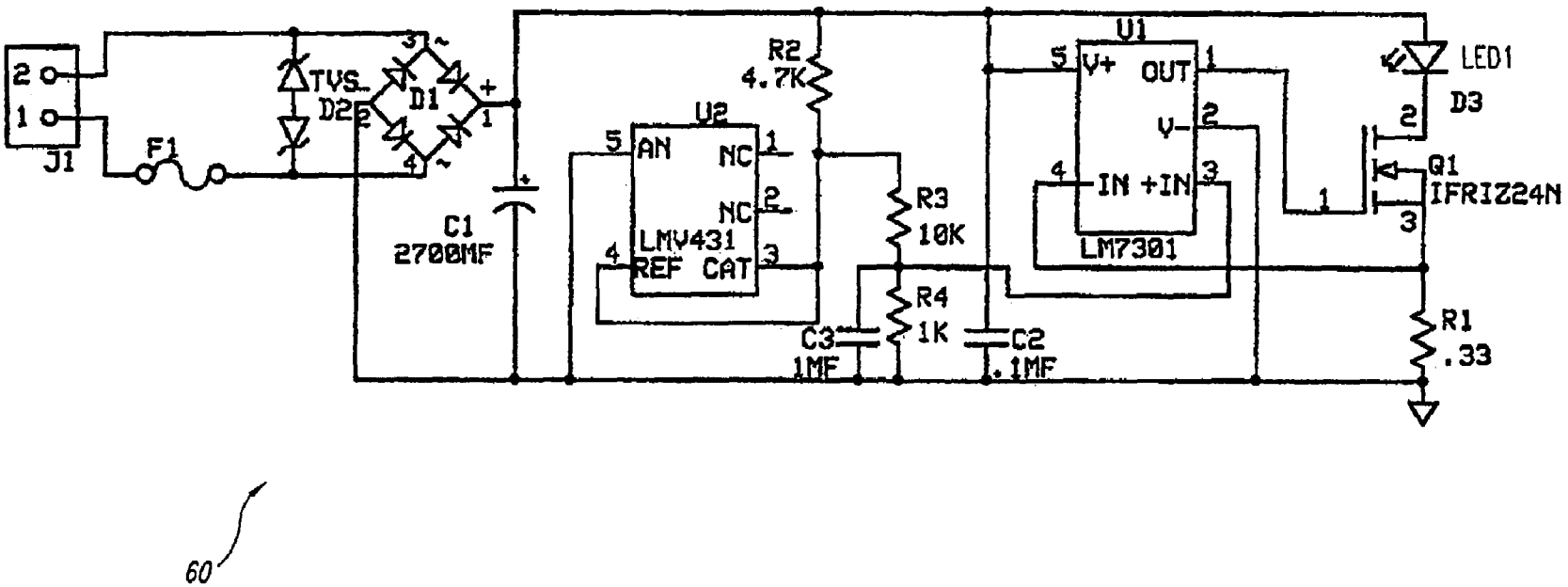
FIG. 4 is a schematic diagram of a controller circuit of a pathway light according to one non-limiting embodiment.

FIG. 4 is a schematic diagram of a controller 60 that may be used in a luminaire, such as the pathway light 10, according to one non-limiting embodiment. Alternatively, buck type switch-mode current regulators or other controllers may be used in place of the controller 60. The controller 60 receives alternating-current (AC) or direct-current (DC) power from a power source (not shown) at J1. In the case of AC voltage, the AC voltage of the received power is converted to direct-current (DC) voltage by D1 and C1. In the case of DC voltage, D1 passes the DC voltage in a polarity independent way so wiring polarity does not need to be observed. A voltage reference is provided by U2 and stable over variations in ambient temperature and supply voltage, and sets a reference that is a set point for the current output to the light source of the pathway light 10, represented by LED1 in FIG. 4. The amplifier U1 detects the difference between the current through LED1 and the set point. If the current through LED1 is less than the set point, U1 increases the gate bias on transistor Q1 to increase the current. Conversely, if the current through LED1 is greater than the set point, the gate bias on Q1 is decreased to decrease the current through LED1. Resistor R1 is a sense resistor that measures the current flowing through LED1 by converting the current to a voltage for input to U1. Resistors R3 and R4 form a voltage divider that divides the voltage reference from a standard 1.24 volt to a lower voltage so that a small value resistor may be used for resistor R1. Because the power dissipated by R1 is $I_{LED1}{}^2$*R1, a smaller R1 wastes less power and provides for a lower dropout voltage (loss of regulation) for the controller 60. The use of a power field-effect transistor (FET) type of pass transistor for Q1 enables a very low dropout voltage and low gate current consumption. Alternatively, a bipolar-junction transistor (BJT) would work in the controller 60 albeit with reduced performance. Resistor R2 provides bias current for reference U2. The dual diode setup D2 serves to protect against damaging power line transients. Fuse F1 protects the rest of the circuit of controller 60 from short circuit or failure of the other electronic components, and from a power source voltage exceeding the limiting value of D2. Capacitors C2 and C3 are bypass capacitors that provide noise filtering and stability to the reference U2 and amplifier U1.

The controller 60 permits full light output operation of the luminaire to within less than 1 volt of the minimum voltage needed to power the light source for emission of light because of the low dropout voltage of the controller 60. If the supply voltage falls below the minimum level for full output, the controller 60 continues to allow the light source to emit some light, reducing in intensity as the voltage falls. In one embodiment, the luminaire uses standard 12 VAC power that is commonly used with traditional pathway lights ("low voltage lighting"). In one embodiment, two or more power wires enter the housing of the luminaire and are attached to the power source wires using "wire nuts", insulation displacement connectors, soldering or other method.

An additional benefit provided by a luminaire employing the controller 60 is the substantial reduction in the consumption of power. This is because of the direct illumination of the pathway (or whatever surface is to be illuminated) and the use of a solid-state type of light source, such as the LED device 50, coupled with the specially designed electronic control circuit, such as the controller 60. Another benefit provided is the ability of the controller 60 to operate over voltages very close to the minimum voltage required by the solid-state light source, thus enabling the low voltage supply to be fully loaded (which causes a voltage drop), which in turn enables the use of smaller power sources versus traditional light sources.

The above description of illustrated embodiments, including what is described in the Abstract, is not intended to be exhaustive or to limit the embodiments to the precise forms disclosed. Although specific embodiments and examples are described herein for illustrative purposes, various equivalent modifications can be made without departing from the spirit and scope of the disclosure, as will be recognized by those skilled in the relevant art. The teachings provided herein of the various embodiments can be applied to other contexts, not necessarily the exemplary context of pathway illumination generally described above.

For example, instead of using the standard 12 VAC power as the power source, in one embodiment the power source may be an alternative power source such as a battery, super- or ultra-capacitor, fuel cell, photo-voltaic cell, wind turbine, geothermal pump, etc. In another embodiment the power source may be any combination of the standard 12 VAC power and one of the aforementioned alternative energy sources, or any combination thereof. Of course, the controller 60 will be appropriately modified to adapt to the power source in order to provide regulated power to the light source.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

We claim:

1. A luminaire to illuminate surfaces, the luminaire comprising:

a housing having a bottom surface and a top surface that has two sloped portions that each slope toward the bottom surface from an intermediate portion therebetween, the housing including an interior and at least one window providing access between the interior of the housing and an exterior of the housing, and the housing constructed to withstand contact by a piece of moving equipment;

a mounting plate extending at least approximately perpendicularly downward with respect to the bottom surface to secure the housing to a peripheral portion of a concrete pathway having a surface portion to be illuminated, wherein in use the bottom surface of the housing is carried by the concrete pathway on a portion that is at least approximately parallel to the surface portion to be illuminated and the mounting plate is proximally adjacent and parallel to the peripheral portion of the concrete pathway, the peripheral portion which extends at least approximately perpendicularly with respect to the surface portion to be illuminated; and a light source received in the interior of the housing, the light source having a principal axis of emission that is directed outwardly through the window of the housing at a downwardly oriented angle with respect to the bottom surface such that, when in use with the luminaire mounted to the surface portion to be illuminated, the principal axis of emission of the light source is directed at the surface portion to be illuminated of the concrete pathway.

2. The luminaire of claim 1 wherein the mounting plate includes at least one mounting hole extending perpendicularly therethrough, the at least one mounting hole sized to receive a portion of a respective fastener to secure the luminaire to the concrete pathway.

3. The luminaire of claim 1 wherein the housing and the mounting fixture are each separate unitary parts that are physically coupled together.

4. The luminaire of claim 1 wherein the light source includes at least one light emitting device.

5. The luminaire of claim 1 wherein the light source includes at least one solid-state light emitting device.

6. The luminaire of claim 1 wherein the light source includes at least one light-emitting diode.

7. The luminaire of claim 1, further comprising:

a controller coupled to regulate power to the light source.

8. The luminaire of claim 7 wherein the controller is configured to regulate power at a voltage level within a threshold from a voltage level of a power source to permit full light emission by the light source.

9. The luminaire of claim 7 wherein the controller is configured to regulate power to the light source to adjust an intensity of the light emitted by the light source according to a voltage of power from a power source.

10. The luminaire of claim 7, further comprising:

a controller housing physically coupled to the mounting plate, the controller housing having an interior in which the controller is received, wherein the housing, the mounting plate and the controller housing each includes at least one respective passage to provide communication between the controller in the interior of the controller housing and the light source in the interior of the housing.

11. The luminaire of claim 7 wherein the controller comprises a low dropout voltage regulator configured to adjust an intensity of the light emitted by the light source according to a voltage level of the power from a power input.

12. The luminaire of claim 1 wherein the window includes a substantially transparent member positioned in an opening of the housing to environmentally isolate the interior of the housing from the exterior thereof.

13. The luminaire of claim 12 wherein the substantially transparent member comprises a toughened glass made of one of Chrysterna and Pyrex.

14. The luminaire of claim 12 wherein the substantially transparent member is coated with one of artificial diamond-like deposition and sapphire.

15. The luminaire of claim 1 wherein the window has a shape that forms the light emitted by the light source into a light beam when exiting the housing, the light beam having a vertical angle of +/−10 degrees relative to a horizontal plane parallel to the surface to be illuminated and a horizontal angle of at least +/−70 degrees along the horizontal plane.

16. The luminaire of claim 1 wherein the housing has a height of less than 0.75 inch measured from the surface when positioned on the surface to be illuminated.

17. The luminaire of claim 1 wherein the interior of the housing is environmentally sealed from the exterior thereof.

18. The luminaire of claim 1 wherein a top portion of the interior of the housing, at least partially between the light source and the window, has high reflectance, and wherein a bottom portion of the interior of the housing, at least partially between the light source and the window, has low reflectance.

* * * * *